US010696052B1

(12) United States Patent
LeFevre et al.

(10) Patent No.: US 10,696,052 B1
(45) Date of Patent: Jun. 30, 2020

(54) SUBMERSION CAP DEVICES STABILIZING INK IN NOZZLES OF INKJET PRINTHEADS

(71) Applicant: Xerox Corporation, Norwalk, CT (US)

(72) Inventors: Jason M. LeFevre, Penfield, NY (US); Douglas K. Herrmann, Webster, NY (US); Paul J. McConville, Webster, NY (US); Chu-heng Liu, Penfield, NY (US); Seemit Praharaj, Webster, NY (US); Michael J. Levy, Webster, NY (US); David A. VanKouwenberg, Avon, NY (US); Linn C. Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/272,057

(22) Filed: Feb. 11, 2019

(51) Int. Cl.

| | |
|---|---|
| ***B41J 2/165*** | (2006.01) |
| ***B41J 29/38*** | (2006.01) |
| ***B41J 2/19*** | (2006.01) |
| ***B41J 2/17*** | (2006.01) |

(52) U.S. Cl.
CPC ..... *B41J 2/16538* (2013.01); *B41J 2/16523* (2013.01); *B41J 2/16532* (2013.01); *B41J 2/16547* (2013.01); *B41J 2/1707* (2013.01); *B41J 2/19* (2013.01); *B41J 29/38* (2013.01); *B41J 2002/16502* (2013.01)

(58) Field of Classification Search
CPC ..... B41J 2/16538; B41J 2/19; B41J 2/16532; B41J 29/38; B41J 2/16547; B41J 2/1707; B41J 2/16523; B41J 2002/16502
See application file for complete search history.

(56) References Cited

U.S. PATENT DOCUMENTS

| | | | |
|---|---|---|---|
| 4,296,418 | A | 10/1981 | Yamazaki et al. |
| 4,364,065 | A | 12/1982 | Yamamori et al. |
| 4,571,601 | A | 2/1986 | Teshima |
| 4,746,938 | A | 5/1988 | Yamamori et al. |
| 4,947,187 | A | 8/1990 | Iwagami |
| 5,300,958 | A | 4/1994 | Burke et al. |

(Continued)

FOREIGN PATENT DOCUMENTS

| | | | |
|---|---|---|---|
| DE | 102011002727 | A1 | 7/2012 |
| EP | 1 827 839 | B1 | 2/2009 |

(Continued)

OTHER PUBLICATIONS

Kwon et al., "Measurement of Inkjet First-Drop Behavior Using a High-Speed Camera," Review of Scientific Instruments; vol. 87, Issue 3, 2016, AIP Publishing, pp. 1-11.

*Primary Examiner* — Yaovi M Ameh
(74) *Attorney, Agent, or Firm* — Gibb & Riley, LLC

(57) ABSTRACT

A cap is positioned to contact a printhead when the printhead is not ejecting liquid ink onto print media. A dispenser dispenses an ink stabilizing material into the cap. A blocking structure is positioned in the cap to contact vent openings of the inkjet printhead when the inkjet printhead is in the cap and is in a location to submerge the nozzles in the ink stabilizing material in the cap. An ink control device draws the ink stabilizing material into nozzles of the inkjet printhead when the vent openings are blocked by the blocking structure. The ink control device subsequently draws the ink stabilizing material into the vent openings when the vent openings are separated from the blocking structure.

20 Claims, 15 Drawing Sheets

(56) References Cited

U.S. PATENT DOCUMENTS

| | | | | |
|---|---|---|---|---|
| 5,394,178 | A | 2/1995 | Grange | |
| 5,412,411 | A | 5/1995 | Anderson | |
| 5,635,965 | A | 6/1997 | Purwins et al. | |
| 5,663,751 | A | 9/1997 | Holbrook | |
| 5,670,997 | A * | 9/1997 | Sugimoto | B41J 2/16508 347/30 |
| 5,726,692 | A | 3/1998 | Yamaguchi et al. | |
| 5,936,647 | A | 8/1999 | Rhodes et al. | |
| 5,949,448 | A | 9/1999 | Man et al. | |
| 5,980,622 | A | 11/1999 | Byers | |
| 6,106,098 | A | 8/2000 | Nakamura et al. | |
| 6,135,585 | A | 10/2000 | Johnson et al. | |
| 6,508,533 | B2 | 1/2003 | Tsujimoto et al. | |
| 6,726,304 | B2 | 4/2004 | Fassler et al. | |
| 7,156,514 | B2 | 1/2007 | Rosa | |
| 7,753,475 | B2 | 7/2010 | Berry et al. | |
| 7,810,899 | B2 | 10/2010 | Usui et al. | |
| 7,992,986 | B2 | 8/2011 | Snyder et al. | |
| 8,592,503 | B2 | 11/2013 | Bogale et al. | |
| 2001/0026299 | A1 * | 10/2001 | Tsujimoto | B41J 2/16532 347/30 |
| 2002/0180853 | A1 | 12/2002 | Ohsawa et al. | |
| 2003/0227505 | A1 | 12/2003 | Tanaka et al. | |
| 2003/0231222 | A1 | 12/2003 | Jefferson et al. | |
| 2006/0119645 | A1 | 6/2006 | Berry et al. | |
| 2006/0164460 | A1 | 7/2006 | Uwagaki et al. | |
| 2007/0046721 | A1 | 3/2007 | Miyazawa | |
| 2007/0076045 | A1 | 4/2007 | James et al. | |
| 2007/0085875 | A1 | 4/2007 | Shimazaki et al. | |
| 2007/0252863 | A1 | 11/2007 | Sun et al. | |
| 2007/0263026 | A1 | 11/2007 | Shang et al. | |
| 2008/0018677 | A1 | 1/2008 | White et al. | |
| 2008/0024532 | A1 | 1/2008 | Kim | |
| 2008/0204501 | A1 | 8/2008 | Kurita et al. | |
| 2009/0174748 | A1 | 7/2009 | Balcan et al. | |
| 2009/0237424 | A1 | 9/2009 | Martin et al. | |
| 2010/0073445 | A1 | 3/2010 | Silverbrook et al. | |
| 2011/0080443 | A1 | 4/2011 | Terame | |
| 2012/0162311 | A1 | 6/2012 | Taira | |
| 2013/0215189 | A1 | 8/2013 | Justice et al. | |
| 2017/0072720 | A1 | 3/2017 | Yamagishi | |
| 2017/0203573 | A1 * | 7/2017 | Hiramoto | B41J 2/16508 |
| 2018/0079217 | A1 | 3/2018 | Hiratsuka et al. | |
| 2018/0244048 | A1 | 8/2018 | Ito | |

FOREIGN PATENT DOCUMENTS

| | | | |
|---|---|---|---|
| JP | 4937785 | B2 | 5/2012 |
| KR | 10-1397307 | B1 | 5/2014 |
| WO | 2008026417 | A1 | 3/2008 |

* cited by examiner

SUBMERSION CAP DEVICES STABILIZING INK IN NOZZLES OF INKJET PRINTHEADS

BACKGROUND

Systems and methods herein generally relate to inkjet printers and more particularly to submersion cap devices that stabilize ink in nozzles of inkjet printheads.

Inkjet printers eject drops of liquid marking material (e.g., ink) from nozzles or "jets" of printheads in patterns to perform printing. Nozzles of such inkjet printheads routinely clog when such are unused for extended periods, for example when an inkjet printer does not print for an extended period, or when certain colors or nozzles go unused for an extended period.

This can result in nozzles that do not eject any ink, or that only eject a significantly reduced drop mass, which causes less than optimal pixel placement ("streaky" solid-fill images) and lower than target drop mass (lighter than target solid-densities). If the condition goes uncorrected, it can lead to intermittent firing and the jet can eventually cease firing, and such a situation can be unrecoverable resulting in irreversible printhead damage. Depending on the pre-condition of the head, the time scale for onset of such unrecoverable failure could range from a few hours to an overnight/weekend of idle time.

Additionally, certain colors (e.g., magenta, etc.) are more susceptible to clogging relative to other colors, because certain color inks dry faster than other color inks, which causes the ink to dry in the nozzles of the printhead during extended inactivity. Such nozzle clogging issues can be mitigated, but not avoided, by purge and cleaning cycles.

SUMMARY

Devices herein are highly useful because they stabilize the ink in the nozzles of the inkjet printheads and prevent the nozzles/vents from clogging, etc., which might otherwise occur during extended periods of nozzle inactivity. More specifically, exemplary apparatuses herein include, among other components, an inkjet printhead and a printhead resting/parking structure that the inkjet printhead contacts when the inkjet printhead is not ejecting ink on print media. The inkjet printhead includes a nozzle plate (that includes nozzles that are adapted to eject ink), vent openings that are positioned and adapted to release air bubbles from within the ink supply, and ink supply structures positioned and adapted to supply the ink to the nozzles. The ink supply structures are also in ink communication with the vent openings to allow release of air bubbles.

The printhead resting structure includes a cap positioned to contact the inkjet printhead when the inkjet printhead is not ejecting the ink on print media, a dispenser connected to the cap and adapted to dispense an ink stabilizing material (e.g., cleaning fluid, flushing solution, water, gel, or any other material that can keep liquid ink from drying out) into the cap, and a blocking structure within the cap. An actuator/support structure is connected to the inkjet printhead and is adapted to move the inkjet printhead relative to the cap so as to move the inkjet printhead to and from the cap between printing operations to store the inkjet printhead in the cap. Additionally, an ink control device is included as part of the inkjet printhead. The ink control device is connected to the ink supply structures and is adapted to allow gravity to act to force the ink into the ink supply structures (or pressure can be applied) and meniscus control is provided through vacuum/pressure applied by the ink control device.

The ink control device is adapted to first draw the ink stabilizing material from the cap into the nozzles when the nozzles are submerged in the ink stabilizing material in the cap using, for example, vacuum force. The ink control device is further adapted to subsequently draw the ink stabilizing material into the vent openings, but only when the vent openings are separated from the blocking structure (but while the vent openings are still submerged in the ink stabilizing material in the cap).

This two-stage control is afforded because the blocking structure herein includes contact surfaces that are shaped and positioned to only block the vent openings without blocking the nozzles. Such contact surfaces are therefore positioned to only prevent the ink stabilizing material from entering the vent openings when the vent openings contact the blocking structure, without preventing the ink stabilizing material from entering the nozzles. Specifically, the blocking structure is shaped and positioned to contact the vent openings when the inkjet printhead is in the cap, and when the inkjet printhead structure is in a position/location so as to submerge the nozzles in the ink stabilizing material that is in the cap. In other words, the blocking structure is shaped to block the vent openings, but not block the nozzles, when the vent openings contact the blocking structure.

A drain is connected to the cap and is adapted to remove the ink stabilizing material from the cap after the ink stabilizing material has been drawn into the nozzles and vent openings. In some embodiments herein, the printhead resting structure also includes a wiper positioned and adapted to wipe the nozzles and vent openings after the ink stabilizing material has been drawn into the nozzles and vent openings.

Using such structures, various methods herein are similarly highly useful because they also stabilize the ink in the nozzles of the inkjet printheads during extended periods of nozzle inactivity. More specifically, such methods dispense the ink stabilizing material such as cleaning fluid, flushing solution, water, gel, etc., into the cap of the printhead resting structure. Once there is sufficient ink stabilizing material in the cap (e.g., a quantity that will submerge the blocking structure) these methods then position (e.g., using the actuator/support structure) the inkjet printhead down into the ink stabilizing material in the cap in a location (to a depth below the top surface of the ink stabilizing material) so as to submerge the nozzles and vent openings of the inkjet printhead in the ink stabilizing material in the cap, and in a location to position the vent openings of the inkjet printhead to contact the contact surfaces of the blocking structure.

After the vent openings are resting on the contact surfaces of the blocking structure, the ink control device then adjusts the ink in the inkjet printhead so as to draw the ink stabilizing material into the nozzles (e.g., by applying vacuum to the ink supply structures). Next, after ink has been drawn into the nozzles, these methods move the inkjet printhead upward so as to separate the vent openings from the blocking structure while continuing to adjust (e.g., apply vacuum to) the ink in the printhead so as to draw the ink stabilizing material into the vent openings.

Again, the ink stabilizing material is drawn into the vent openings, but only when the vent openings are separated from the blocking structure (and the vent openings are submerged in the ink stabilizing material in the cap) to ensure that the ink stabilizing material enters the nozzles. As noted previously, this occurs because the contact surfaces of the blocking structure are shaped and positioned to only block the vent openings without blocking the nozzles. Therefore, the contact surfaces are shaped and positioned to only prevent the ink stabilizing material from entering the vent openings when the vent openings contact the blocking structure, without preventing the ink stabilizing material from entering the nozzles. In other words, the blocking structure is shaped to block the vent openings, but not block the nozzles, when the vent openings contact the blocking structure to ensure that the ink stabilizing material enters the nozzles (which might not necessarily occur if the vent openings are not blocked).

Once the ink has been drawn into the nozzles and vent openings, the inkjet printhead can be optionally moved from the cap and passed over the wiper (again, using the actuator/support structure) to wipe the nozzles and vent openings. The inkjet printhead is then potentially repositioned in the cap (or remains in the cap, if the optional wiping process is not performed). In either situation, once the ink has been drawn into both the nozzles and vent openings, these methods drain the ink stabilizing material from the cap using the drain, after which the inkjet printhead can be stored for extended time periods without risk of the ink drying out or the nozzles/vents clogging. Before resuming printing on print media, these methods can optionally flush the inkjet printhead to remove the ink stabilizing material from the nozzles and the vent openings.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
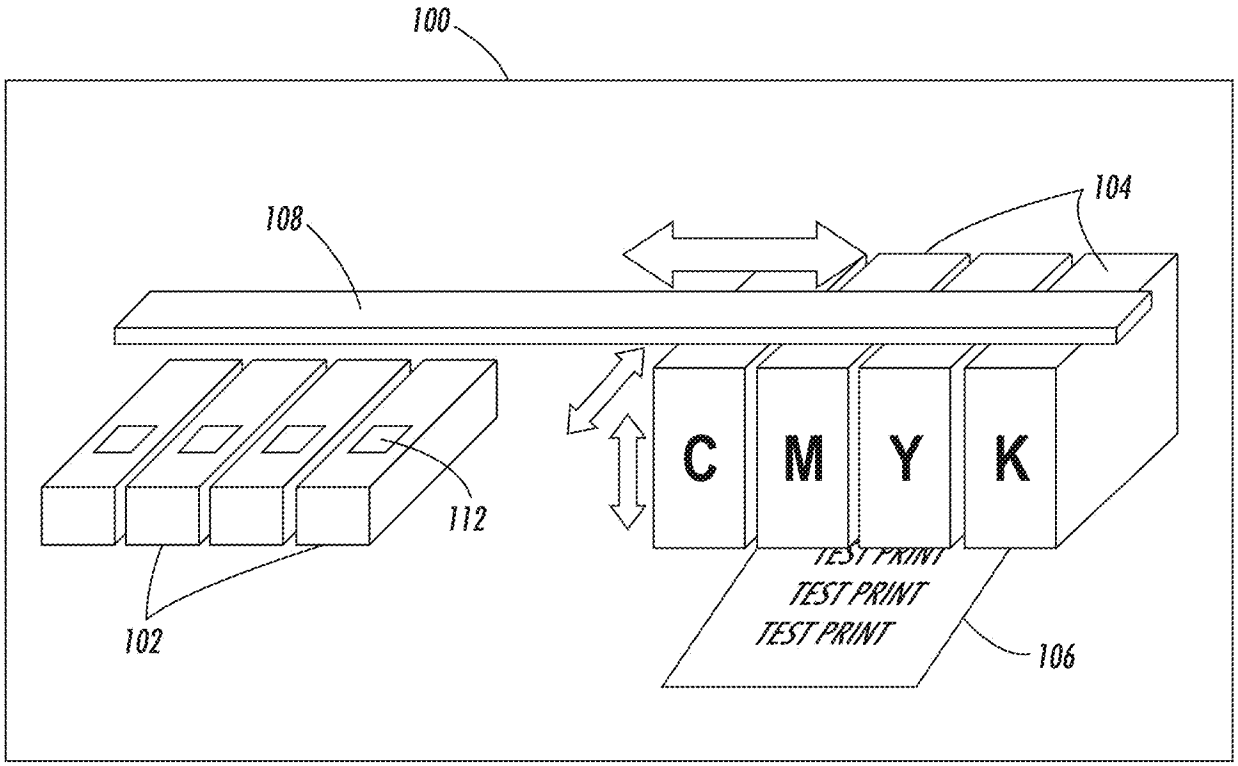
FIGS. 1 and 2 are perspective/exploded conceptual diagrams illustrating inkjet print cartridges and cartridge resting locations of structures herein.

As mentioned above, nozzles of inkjet printheads routinely clog when such are unused for extended periods, and purge and cleaning cycles are not completely effective at preventing clogs. In view of such issues, apparatuses/methods herein stabilize ink in nozzles of inkjet printheads by submerging the inkjet printheads in ink stabilizing material that has previously been dispensed in the cap. Further, the cap includes a blocking structure that blocks vent openings of the inkjet printhead to ensure that the ink stabilizing material first enters the nozzles (which might not necessarily occur if the vent openings are not blocked) before entering the vent openings.

More specifically, methods herein introduce a small amount of ink "flushing" solution (which is sometimes referred to herein as "ink stabilizing material") into the printhead via the nozzle plate during extended periods of inactivity (overnight, weekends, storage, etc.). The cap structure is constructed so that it can hold a sufficient quantity of fresh "flushing" fluid to dilute/replace a volume of ink in the jet-stack.

Prior to a period of extended jetting inactivity, the printhead is lowered into the printhead maintenance (PHM) cap that has been partially filled with a bath of the "flush" fluid, at which point the meniscus control on the ink delivery is controlled to be negative (vacuum), to draw in (via the nozzle plate) a specific amount of the "flush" and stabilize the ink in the head for the extended period.

In some ways, this process can be thought to occur in distinct parts (or continuously) to ensure that "flush" has entered all cavities within the nozzle area before entering vent openings. Specifically, a blocking structure is used to first block the vent apertures on the faceplate of the printhead, requiring the "flush" to be drawn in through the nozzles when a vacuum is applied to the ink supply line. Thus, cap structures herein include a tray insert which is used to block the vent lines during the process of drawing in "flush" solution into nozzles, which maintains jet integrity during long term jetting inactivity. Then, the blocking structure is released from the vents, allowing the flush fluid to also be drawn into the much larger vent lines. Thus, this multi-step approach first draws in "flush" fluid to the nozzles, by initially blocking the vent lines, and then unblocks the vent lines to ensure that "flush" gets into the nozzles, as well as the vent-lines and the finger manifolds.

After a set time for ingesting the "flush" fluid through the nozzle plate, the meniscus control is returned to normal and the "gravity" feed ink delivery system regains fluidic control. After the extended period of idle jetting time, a standard 2× jet-stack purge is performed, and this removes all the ink/flush, leaving only the fresh ink, and the head is ready to print without jetting degradation.

These methods/devices are robust to ink dry-out in the printhead, extending the life of the head and maintaining jetting integrity throughout printhead life. Further these processes are transparent to the customer, which contrasts with manual cleaning/unclogging methods of maintaining the jet integrity, which are operator technique sensitive and inconvenient.

Figure 2:
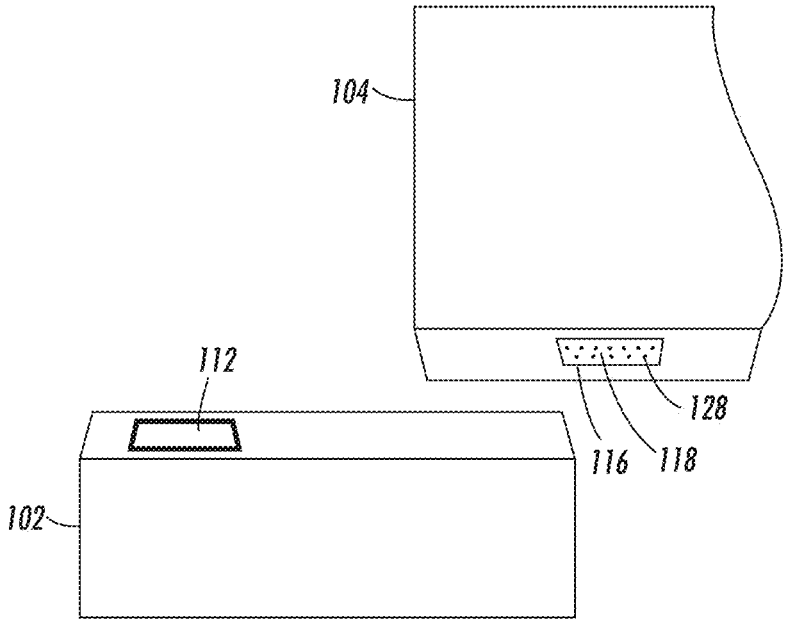

In greater detail, FIGS. 1 and 2 are perspective/exploded conceptual diagrams illustrating some components of an inkjet printing engine 100 that includes inkjet print cartridges 104 and cartridge resting structures 102. One or both of the cartridge resting structures 102 and the inkjet print cartridges 104 are movable along, for example, an actuator/track structure 108. Note, as shown by the block arrows in FIG. 1, the actuator/track structure 108 can move the inkjet print cartridges 104 in many different directions (X, Y, Z, etc.).

In one example, the inkjet printer cartridges 104 are moved by the actuator/track structure 108 into a printing location to print markings (e.g., show as "Test Print" in FIG. 1) on a sheet of print media 106. When printing markings on the sheet of print media 106, the inkjet printers 100 eject drops (droplets) of liquid marking material (e.g., ink, etc.)

from nozzles 118 (jets) in a nozzle plate 128 of inkjet printheads 116 in patterns to perform the printing on the print media 106.

The inkjet print cartridges 104 remain connected to the cartridge resting structures 102 unless the inkjet printing engine 100 is in the process of using the inkjet print cartridges 104 for printing (see FIG. 1, discussed above). After printing, the inkjet print cartridges 104 again return to the cartridge resting structures 102.

Again, the nozzles 118 of such inkjet printheads routinely clog when such are unused for extended periods. Devices herein are highly useful because they stabilize the ink in the nozzles 118 of the inkjet printheads 116 which prevents the nozzles 118 from clogging, etc., that might otherwise occur during extended periods of nozzle inactivity.

Figure 3:
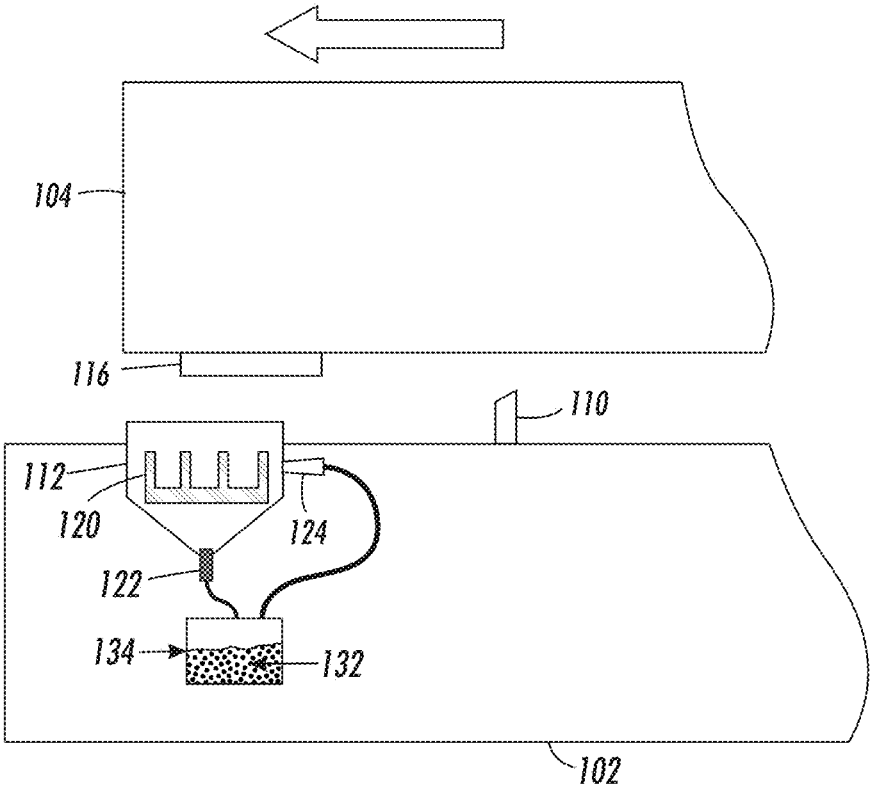
FIG. 3 is a cross-sectional conceptual diagram illustrating an inkjet print cartridge and cartridge resting location of structures herein.
Figure 5:
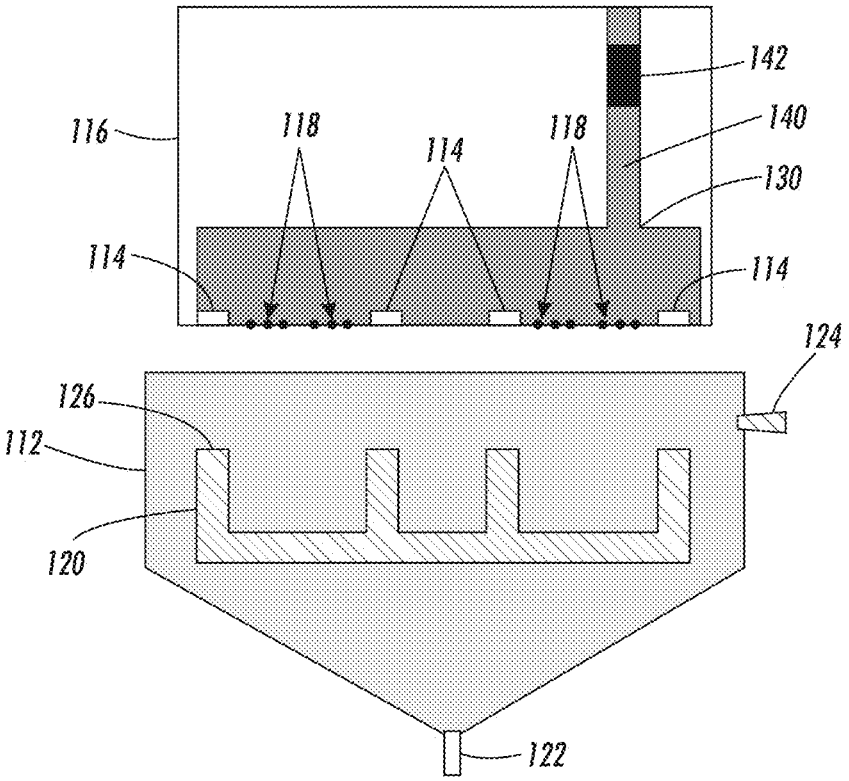
FIGS. 5-8 are cross-sectional conceptual diagrams illustrating a portion of an inkjet print cartridge and cap of structures herein.

As shown in cross-sectional view in FIG. 3, when not printing, the inkjet print cartridges 104 move toward a "parked," "resting," or "home" position (see block arrow in FIG. 3) where they eventually connect to a cap 112 of the cartridge resting structures 102 (as shown more completely in FIG. 5). FIG. 3 also illustrates a wiper 110, blocking structure 120 in the cap 112, a reservoir 134 maintaining an ink stabilizing material 132 that returns from a drain 122 and that is supplied to a dispenser 124, and such elements are discussed in greater detail below.

Figure 4:
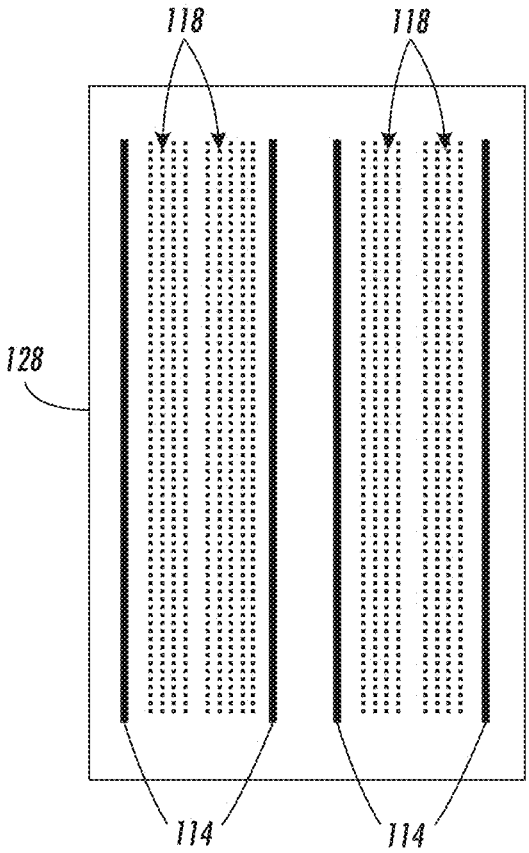
FIG. 4 is a bottom-view conceptual diagram illustrating an inkjet print nozzle plate having nozzles and vent openings.

As shown in FIGS. 2 and 4, the inkjet printhead 116 includes a nozzle plate 128 (that includes nozzles 118 that are adapted to eject ink and vent openings 114 that are positioned and adapted to release air bubbles from within the ink supply) and ink supply structures 130 positioned and adapted to supply the ink to the nozzles 118.

Each vent opening 114 is an exit point to the ink delivery (e.g., via a finger manifold) which penetrates the faceplate, just as the nozzles 118 are also an exit point. Every "finger manifold" on the printhead 116 will have its own vent opening 114. Unlike the nozzles 118, the vent openings 14 do not have an actuator (e.g., piezo-electric, etc.) and the vent openings 114 are larger in diameter than the nozzles 118. The purpose of the vent openings 114 is to allow small amounts of air that might become entrained in the ink path to bypass the nozzles 118, continue to the end of the finger manifold and pass out of the faceplate during a purge. This design is very useful because if air pockets/bubbles get into the nozzles 118 (rather than pass by the nozzles 118 and pass out the vent openings 114), it can make the jetting quality poor or inoperative for nozzles 118 containing air bubbles.

Thus, the ink supply structures 130 are in ink communication with the vent openings 114 to allow release of air bubbles within the ink supply structures 130 and the nozzles 118; however, this ink communication sometimes allows ink to accumulate and dry in the vent openings 114, clogging the vent openings 114 and preventing proper release of air bubbles and venting. In view of this, it is also useful to prevent the vent openings 114 from being clogged with dried ink.

Figure 7:
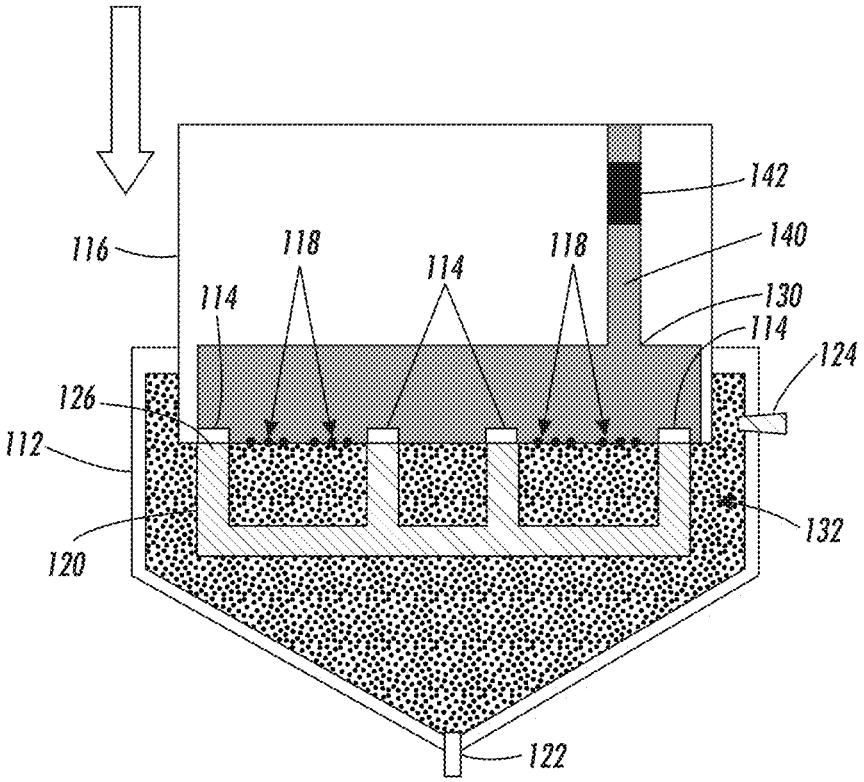
Figure 8:
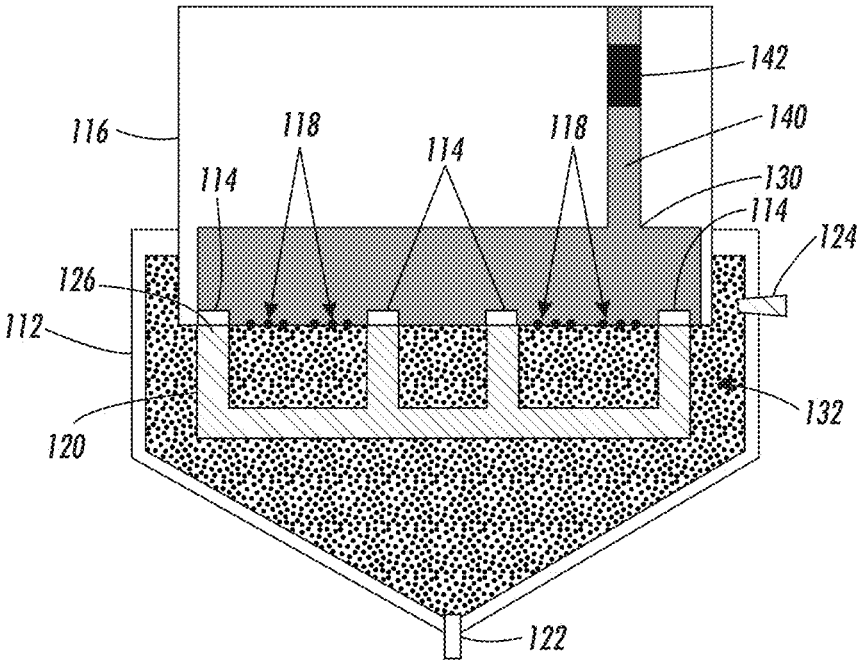
Figure 9:
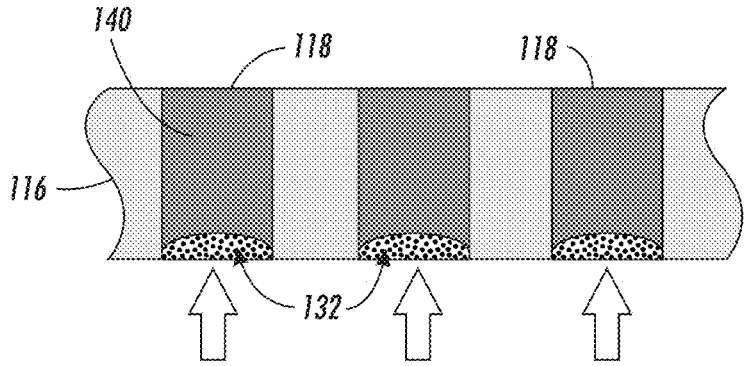
FIG. 9 is a cross-sectional conceptual diagram illustrating nozzles of an inkjet print cartridge of structures herein.

As noted above, FIGS. 5-8 and 10-11 are cross-sectional conceptual diagrams illustrating a portion of an inkjet print cartridge and cap of structures herein, and FIG. 9 is a cross-sectional conceptual diagram illustrating nozzles of an inkjet print cartridge of structures herein. FIGS. 5-11 show a portion of the printhead 116 in position to be connected to the cap 112. The cap 112 is positioned to contact the inkjet printhead 116 when the inkjet printhead 116 is not ejecting the ink 140 on print media 106. Again, the dispenser 124 is connected to the cap 112 and is adapted to dispense a liquid 132 (e.g., cleaning fluid, flushing solution, water, gel, or any other material that can keep liquid ink from drying out) into the cap 112, and a blocking structure 120 is within the cap 112. As noted above, the actuator/support structure 108 is connected to the inkjet printhead 116 and is adapted to move the inkjet printhead 116 relative to the cap 112 so as to move the inkjet printhead 116 to and from the cap 112 between printing operations.

The blocking structure 120 is shaped and positioned to contact the vent openings 114 when the inkjet printhead 116 is in the cap 112, and when the inkjet printhead 116 structure is in a position/location so as to submerge the nozzles 118 in the ink stabilizing material 132 that is in the cap 112.

FIGS. 5-11 also show an ink control device 142 that is included as part of the inkjet printhead 116. The ink control device 142 is connected to the ink supply structures 130 and is adapted to allow gravity to act to force the ink 140 into the ink supply structures 130 (or pressure can be applied by the ink control device 142 to drive the ink 140) and meniscus control is provided through vacuum/pressure applied by the ink control device 142. With structures herein, the ink control device 142 is adapted to draw the ink stabilizing material 132 from the cap 112 into the nozzles 118 when the nozzles 118 are submerged in the ink stabilizing material 132 in the cap 112 using, for example, vacuum force.

Also, the ink control device 142 is adapted to draw the ink stabilizing material 132 into the vent openings 114, but only when the vent openings 114 are separated from the blocking structure 120 and the vent openings 114 are submerged in the ink stabilizing material 132 in the cap 112. This occurs because the blocking structure 120 includes contact surfaces 126 that are shaped and positioned to only block the vent openings 114 without blocking the nozzles 118. The contact surfaces 126 are therefore positioned to only prevent the ink stabilizing material 132 from entering the vent openings 114 when the vent openings 114 contact the blocking structure 120, without preventing the ink stabilizing material 132 from entering the nozzles 118.

In other words, the blocking structure 120 is shaped to block the vent openings 114, but not block the nozzles 118, when the vent openings 114 contact the blocking structure 120. This is highly useful because the vent openings 114 are often much larger than the nozzles 118 and if the same vacuum force is simultaneously applied to the vent openings 114 and the nozzles 118, relatively less ink stabilizing material 132 (potentially none) would be drawn into the much smaller nozzles 118. However, because the devices and methods herein first block the vent openings 114, using the blocking structure 120, this allows the ink stabilizing material 132 to be first drawn into the much smaller nozzles 118, ensuring that a sufficient amount of the ink stabilizing material 132 is drawn into the nozzles 118 before the later separation of the blocking structure 120 from the inkjet printhead 116 allows the ink stabilizing material 132 to be subsequently drawn into the larger vent openings 114.

A drain 122 is connected to the cap 112 and is adapted to remove the ink stabilizing material 132 from the cap 112 after the ink stabilizing material 132 has been drawn into the nozzles 118 and vent openings 114. In some embodiments herein, the printhead resting structure 102 also includes a wiper 110 positioned and adapted to wipe the nozzles 118 and vent openings 114, after the ink stabilizing material 132 has been drawn into the nozzles 118 and vent openings 114, to remove any excess ink stabilizing material 132 and leave the ink stabilizing material 132 in both the nozzles 118 and vent openings 114.

While many different devices and controls can be utilized to accomplish the foregoing, in one non-limiting example of structures herein, the actuator/support structure 108 can include limit switches that control the lowering and positioning of the inkjet printhead 116 so that the vent openings 114 rest on the contact surfaces 126 when the inkjet printhead 116 is lowered into the cap 112. Further, the actuator/support structure 108 can include a sensor that senses when the vent openings 114 rest on the contact surfaces 126 and that outputs a "vacuum" signal to the ink control device 142. The ink control device 142 can include a control which, upon receipt of the vacuum signal, causes the ink control device 142 to apply vacuum to the ink supply structures 130. The actuator/support structure 108 can include a timer that counts down a timer count representing the amount of time needed to allow the ink stabilizing material 132 to be drawn into the vent openings 114. When the timer count expires (after the ink control device 142 has been supplied the vacuum signal) this causes the actuator/support structure 108 to raise the inkjet printhead 116 an amount to separate the vent openings 114 from the contact surfaces 126 to then allow the ink stabilizing material 132 to be drawn into the vent openings 114. Similarly, the timer can use another counter to provide and "end" signal terminating the vacuum operation of the ink control device 142. That same end signal from the timer (or a different signal from a different timer) can cause the actuator/support structure 108 to remove the printhead 116 from the cap 112, can be used to cause the drain to open, etc.

Figure 15:
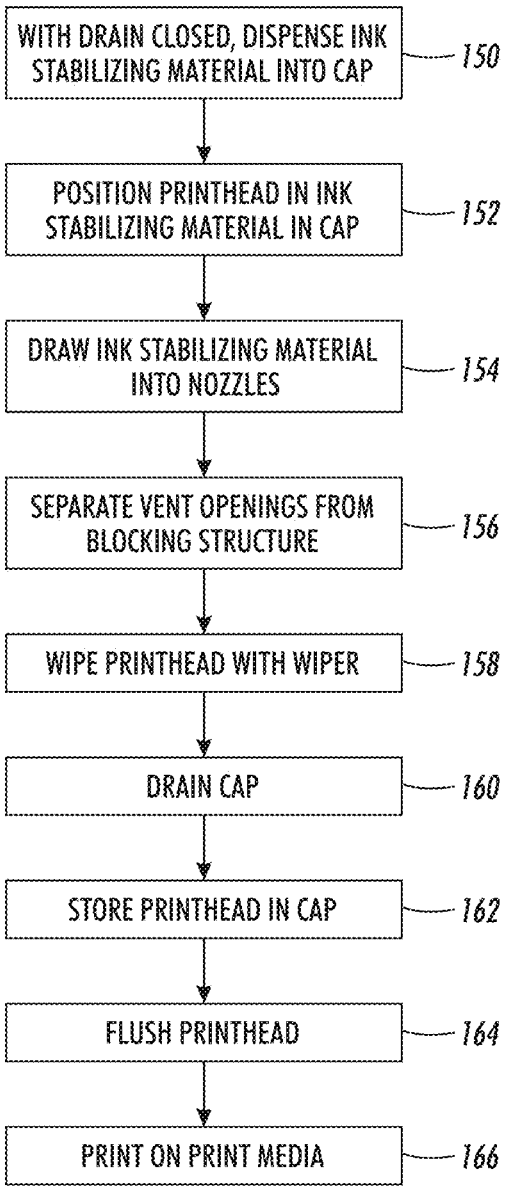
FIG. 15 is a flowchart illustrating aspects of methods herein.

FIG. 15 illustrates some aspects of various methods herein. Again, these methods are similarly highly useful because they stabilize the ink in the nozzles of the inkjet printheads during extended periods of nozzle inactivity. More specifically, as shown in item 150 in FIG. 15, with the drain at the bottom of the cap closed, such methods dispense the ink stabilizing material such as cleaning fluid, flushing solution, water, gel, etc., into the cap of the printhead resting structure.

In item 152 (which can occur before, during, or after item 150) these methods then position (e.g., using the actuator/support structure) the inkjet printhead down into the ink stabilizing material in the cap in a location (to a depth below the top of the ink stabilizing material) so as to submerge the nozzles and vent openings of the inkjet printhead in the ink stabilizing material in the cap, and in a location to position the vent openings of the inkjet printhead to contact the contact surfaces of the blocking structure.

After the vent openings are resting on the contact surfaces of the blocking structure in item 152, the ink control device then adjusts the ink in the inkjet printhead so as to draw the ink stabilizing material into the nozzles (e.g., by applying vacuum to the ink supply structures) in item 154. Next, after an established quantity of the ink stabilizing material has been drawn into the nozzles in item 154, these methods move the inkjet printhead upward so as to separate the vent openings from the blocking structure while continuing to adjust (e.g., apply vacuum to) the ink in the printhead so as to draw the ink stabilizing material into the vent openings in item 156.

Again, the ink stabilizing material is drawn into the vent openings in item 156, but only when the vent openings are separated from the blocking structure (and the vent openings are submerged in the ink stabilizing material in the cap) to ensure that the ink stabilizing material enters the nozzles first in item 154. As noted previously, this occurs because the contact surfaces of the blocking structure are shaped and positioned to only block the vent openings without blocking the nozzles. Therefore, the contact surfaces are shaped and positioned to only prevent the ink stabilizing material from entering the vent openings when the vent openings contact the blocking structure, without preventing the ink stabilizing material from entering the nozzles. In other words, the blocking structure is shaped to block the vent openings, but not block the nozzles, when the vent openings contact the blocking structure to ensure that the ink stabilizing material enters the nozzles (which might not necessarily occur if the vent openings are not blocked because the nozzles are much smaller than the vent openings).

Once the ink stabilizing material has been drawn into the nozzles and vent openings, the inkjet printhead can be optionally moved from the cap and passed over the wiper (again, using the actuator/support structure) to wipe the nozzles and vent openings in item 158. The inkjet printhead is then potentially repositioned in the cap (or remains in the cap, if the optional wiping process is not performed). In either situation, once the ink stabilizing material has been drawn into both the nozzles and vent openings, these methods drain the ink stabilizing material from the cap using the drain in item 160.

In item 162, the inkjet printhead can be stored in the cap for extended time periods without risk of the ink drying out or the nozzles/vents clogging because of the presence of the ink stabilizing material in the nozzles and vents. As shown in item 164, before resuming printing on print media, these methods can optionally flush the inkjet printhead by ejecting a set amount of flushing solution through the nozzles to remove the ink stabilizing material from the nozzles and the vent openings. Then, item 166 shows moving the inkjet printhead to a printing position and using the inkjet printhead to print on print media.

Figure 16:
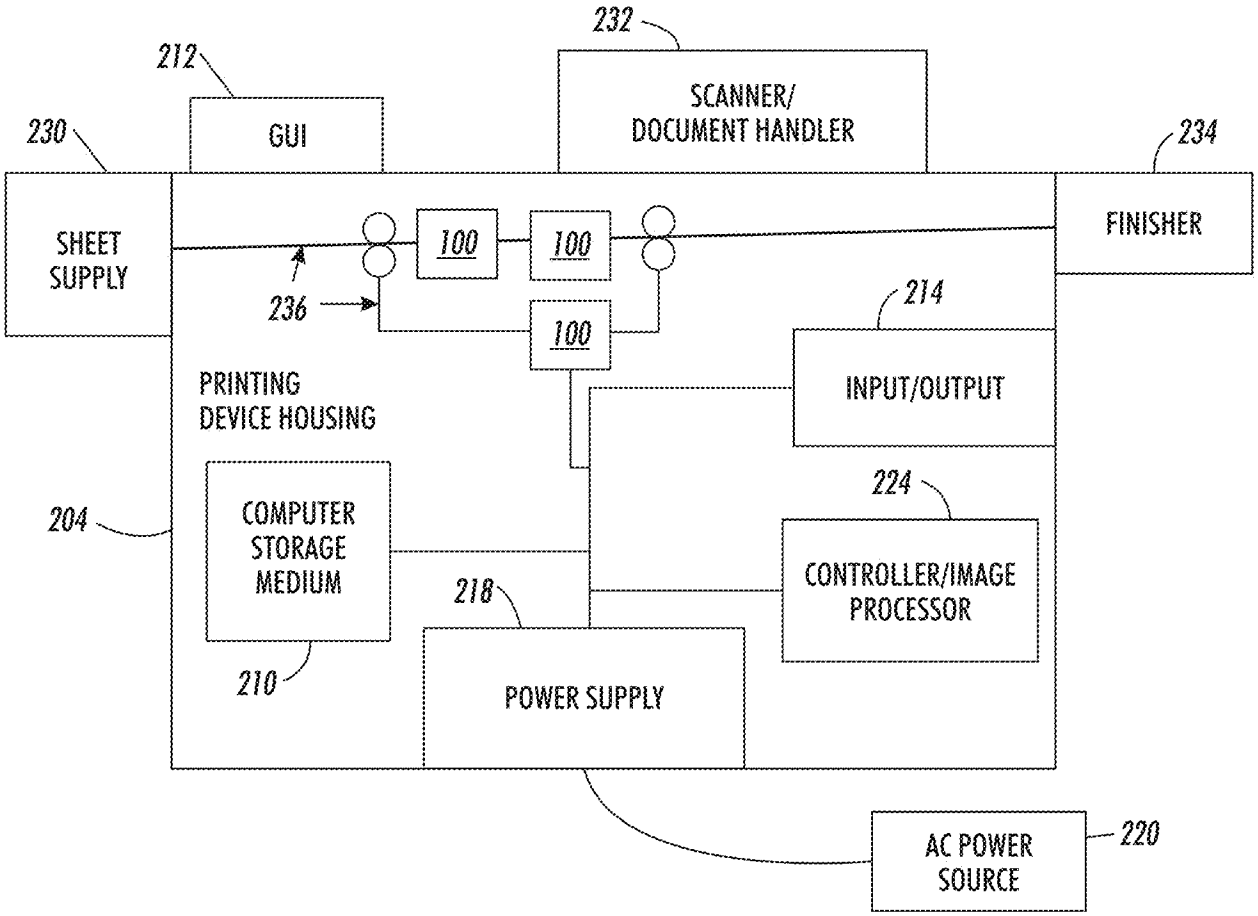
FIG. 16 is a conceptual diagram illustrating printing devices herein.

FIG. 16 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 16, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 100 that use marking material, and are operatively connected to a specialized image processor 224 (that may be different from a general purpose computer because it is specialized for processing image data), a media path 236 positioned to supply continuous media or sheets of media from a sheet supply 230 to the marking device(s) 100, etc. After receiving various markings from the printing engine(s) 100, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 100 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 100 can include, for example, inkjet printheads, contact printheads, three-dimensional printers, etc.

Figure 6:
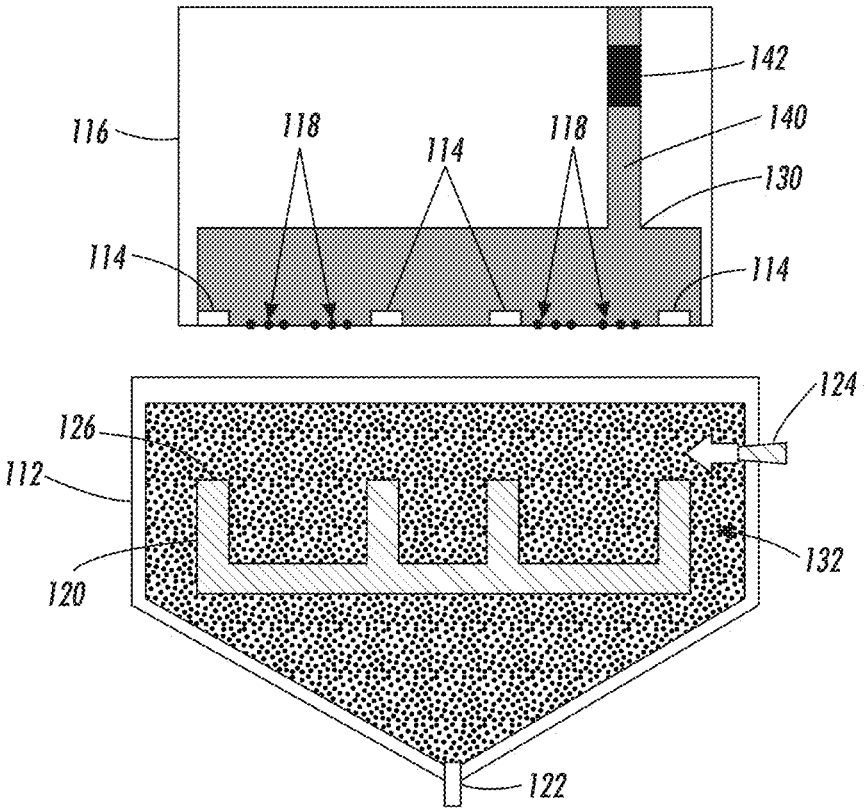

Thus, referring to the previously discussed figures, the processor 224 automatically controls the dispenser 124 to dispense the ink stabilizing material 132 into the cap 112 (FIG. 6). Once there is sufficient ink stabilizing material 132 in the cap 112 (e.g., a quantity that will fully submerge the blocking structure 120), the processor 224 automatically then positions (e.g., by controlling the actuator/support structure 108) the inkjet printhead 116 down into the ink stabilizing material 132 in the cap 112 in a location (to a depth below the top surface of the ink stabilizing material 132) so as to submerge the nozzles 118 and vent openings 114 and in a location to position the vent openings 114 to contact the contact surfaces 126 of the blocking structure 120 (FIG. 7).

Figure 10:
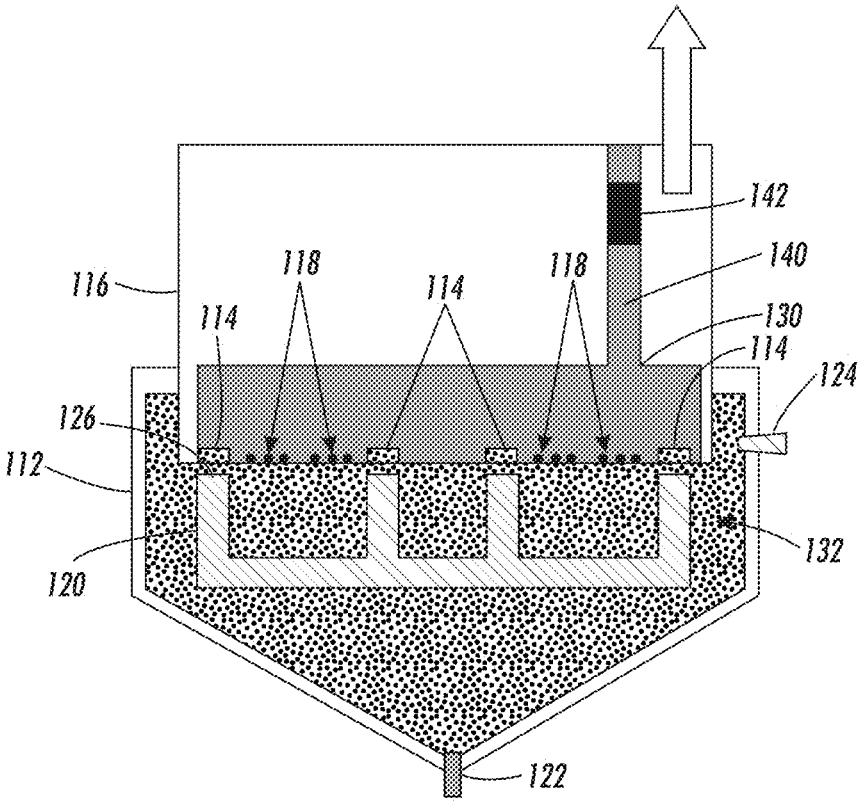
FIGS. 10-11 are cross-sectional conceptual diagrams illustrating a portion of an inkjet print cartridge and cap of structures herein.
Figure 11:
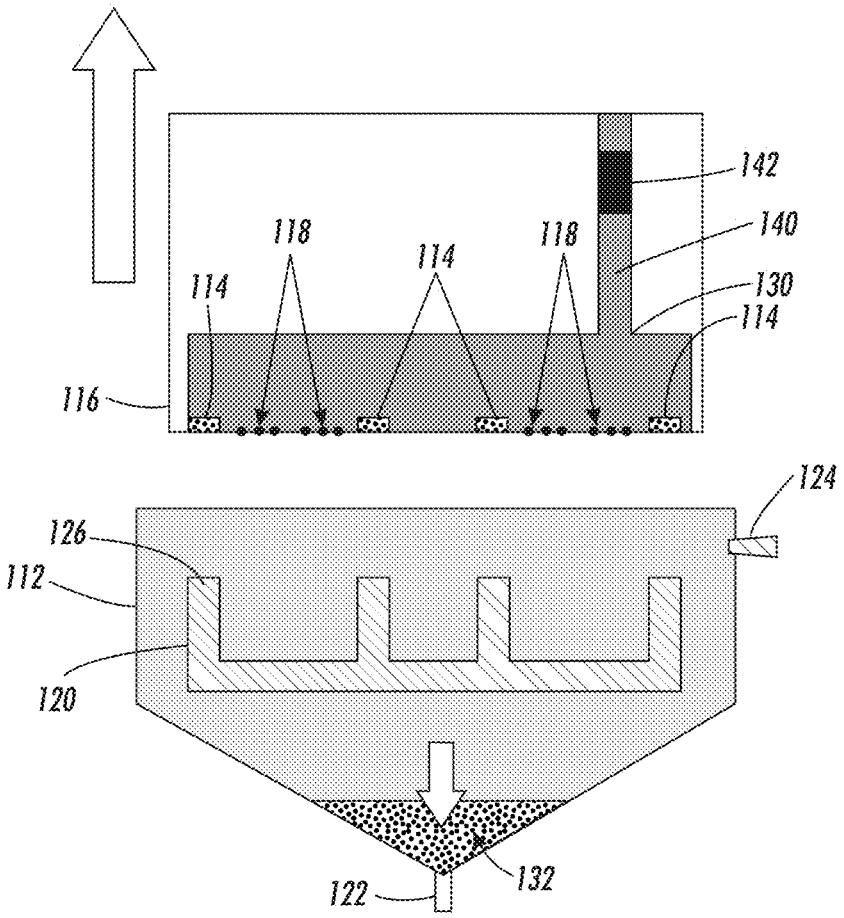

After the vent openings 114 are resting on the contact surfaces 126 of the blocking structure 120, the processor 224 automatically then controls the ink control device 142 to adjust the ink 140 in the inkjet printhead 116 so as to draw the ink stabilizing material 132 into the nozzles 118 (e.g., by applying vacuum to the ink supply structures 130) as shown in FIGS. 8-9. Next, after ink stabilizing material 132 has been drawn into the nozzles 118, the processor 224 automatically controls the actuator/support structure 108 to move the inkjet printhead 116 upward (e.g., in a direction away from the drain 122) so as to separate the vent openings 114 from the blocking structure 120 while continuing to control the ink control device 142 to continue to adjust (e.g., apply vacuum to) the ink 140 in the printhead 116 so as to draw the ink stabilizing material 132 into the vent openings 114 (FIG. 10).

Figure 12:
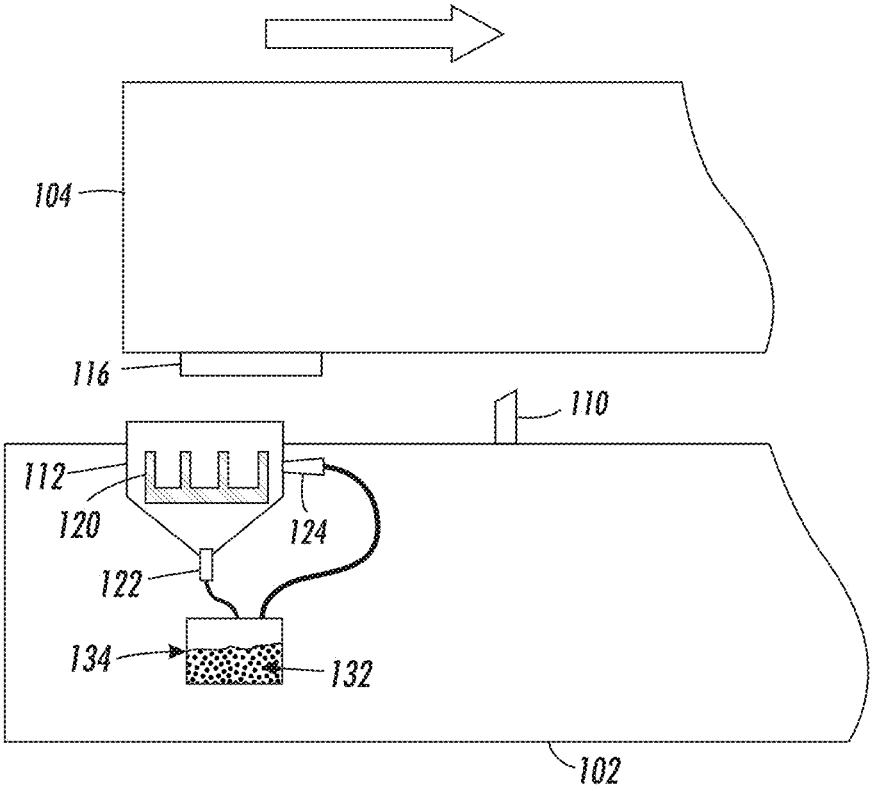
FIG. 12-14 are cross-sectional conceptual diagrams illustrating an inkjet print cartridge and cartridge resting location of structures herein.
Figure 13:
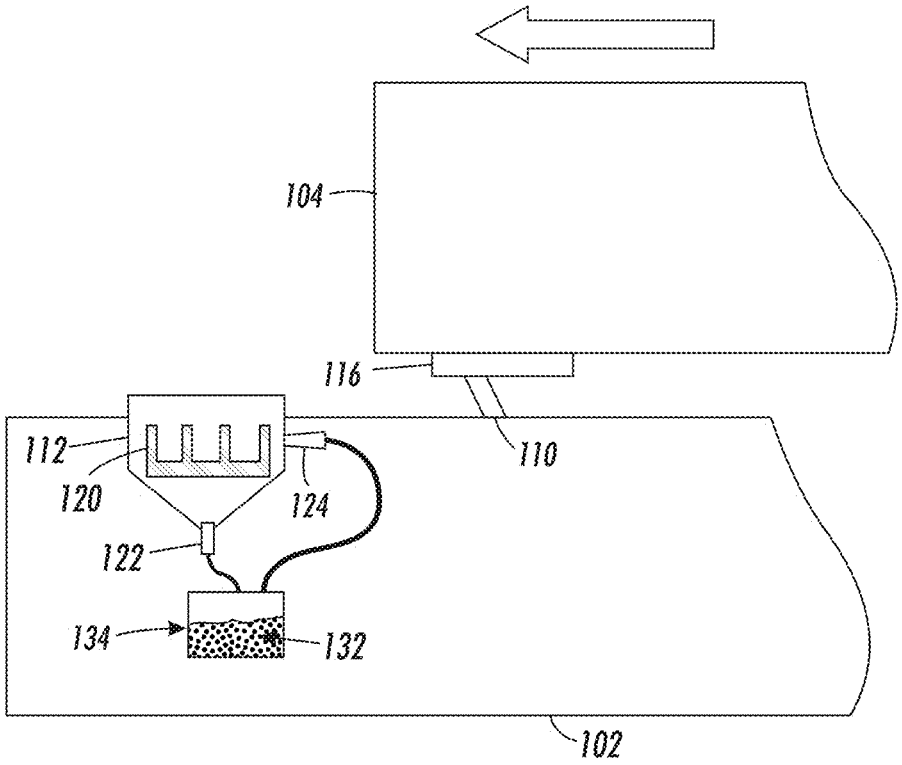

Once the ink stabilizing material 132 has been drawn into the nozzles 118 and vent openings 114, as shown in FIGS. 12-13, the processor 224 automatically controls the actuator/support structure 108 to move the inkjet printhead 116 from the cap so that the inkjet printhead is passed over the wiper 110 to wipe the nozzles 118 and vent openings 114 to remove any excess ink stabilizing material 132 and leave the ink stabilizing material 132 in the nozzles 118 and vent openings 114.

Figure 14:
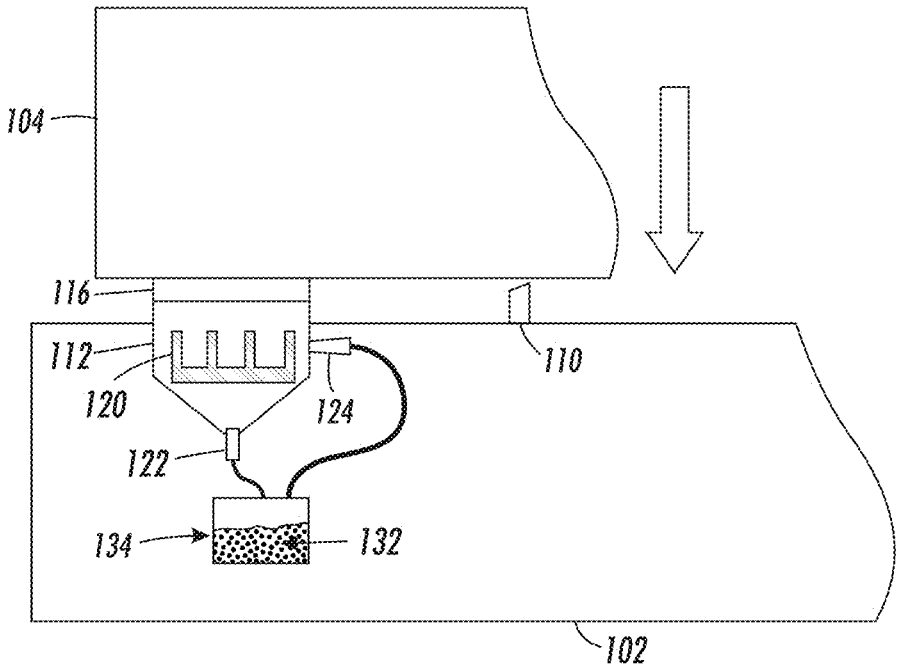

The processor 224 automatically controls the actuator/support structure 108 such that the inkjet printhead 116 is potentially positioned back into the cap 112 (or remains in the cap 112, if the optional wiping process is not performed) for extended storage. In either situation, once the ink stabilizing material 132 has been drawn into both the nozzles 118 and vent openings 114, these the processor 224 automatically controls the drain 122 to drain the ink stabilizing material 132 from the cap 112 (FIG. 11), after which the inkjet printhead 116 can be stored for extended time periods without risk of the ink 140 drying out or the nozzles/vents clogging (FIG. 14). Before resuming printing on print media 106, these processor 224 automatically can optionally flush the inkjet printhead 116 by ejecting a set amount of flushing solution through the nozzles 118 to remove the ink stabilizing material 132 from the nozzles 118 and the vent openings 114.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

an inkjet printhead comprising nozzles and vent openings;

a cap positioned to contact the inkjet printhead;

a dispenser adapted to dispense an ink stabilizing material into the cap;

a blocking structure positioned to contact the vent openings when the inkjet printhead is in the cap in a location to submerge the nozzles in the ink stabilizing material in the cap; and an ink control device adapted to draw the ink stabilizing material into the nozzles when the nozzles are submerged in the ink stabilizing material in the cap, wherein the ink control device is adapted to draw the ink stabilizing material into the vent openings when the vent openings are separated from the blocking structure and the vent openings are submerged in the ink stabilizing material in the cap.

2. The apparatus according to claim 1, wherein the blocking structure includes contact surfaces shaped to block the vent openings and positioned to prevent the ink stabilizing material from entering the vent openings when the vent openings contact the blocking structure.

3. The apparatus according to claim 1, wherein the blocking structure is shaped to block the vent openings and not block the nozzles when the vent openings contact the blocking structure.

4. The apparatus according to claim 1, wherein the cap is a component of a printhead resting structure, and wherein the printhead resting structure comprises a wiper positioned and adapted to wipe the nozzles and vent openings.

5. The apparatus according to claim 1, further comprising a drain connected to the cap and adapted to remove the ink stabilizing material from the cap.

6. The apparatus according to claim 1, further comprising an ink control device adapted to draw the ink stabilizing material into the nozzles by applying a vacuum to ink supply structures.

7. The apparatus according to claim 1, further comprising a support connected to the inkjet printhead and adapted to move the inkjet printhead relative to the cap.

8. An apparatus comprising:

an inkjet printhead comprising: nozzles adapted to eject ink; vent openings positioned and adapted to release air bubbles from within the ink supply; and ink supply structures positioned and adapted to supply the ink to the nozzles;

a cap positioned to contact the inkjet printhead when the inkjet printhead is not ejecting the ink on print media;

a dispenser connected to the cap and adapted to dispense an ink stabilizing material into the cap;

a blocking structure within the cap, wherein the blocking structure is shaped and positioned to contact the vent openings when the inkjet printhead is in the cap in a location to submerge the nozzles in the ink stabilizing material in the cap; and an ink control device connected to the ink supply structures and adapted to draw the ink stabilizing material into the nozzles when the nozzles are submerged in the ink stabilizing material in the cap, wherein the ink control device is adapted to draw the ink stabilizing material into the vent openings when the vent openings are separated from the blocking structure and the vent openings are submerged in the ink stabilizing material in the cap.

9. The apparatus according to claim 8, wherein the blocking structure includes contact surfaces shaped to block the vent openings and positioned to prevent the ink stabilizing material from entering the vent openings when the vent openings contact the blocking structure.

10. The apparatus according to claim 8, wherein the blocking structure is shaped to block the vent openings and not block the nozzles when the vent openings contact the blocking structure.

11. The apparatus according to claim 8, wherein the cap is a component of a printhead resting structure, and wherein the printhead resting structure comprises a wiper positioned and adapted to wipe the nozzles and vent openings.

12. The apparatus according to claim 8, further comprising a drain connected to the cap and adapted to remove the ink stabilizing material from the cap.

13. The apparatus according to claim 8, wherein the ink control device draws the ink stabilizing material into the nozzles by applying a vacuum to the ink supply structures.

14. The apparatus according to claim 8, further comprising a support connected to the inkjet printhead and adapted to move the inkjet printhead relative to the cap.

15. A method comprising:

dispensing ink stabilizing material into a cap of a printhead resting structure, wherein the cap includes a blocking structure;

positioning an inkjet printhead in the cap in a location to submerge nozzles of the inkjet printhead in the ink stabilizing material in the cap and in a location to position vent openings of the inkjet printhead to contact the blocking structure;

adjusting ink in the inkjet printhead to draw the ink stabilizing material into the nozzles;

moving the inkjet printhead to separate the vent openings from the blocking structure while continuing to adjust the ink in the printhead to draw the ink stabilizing material into the vent openings; and draining the ink stabilizing material from the cap.

16. The method according to claim 15, wherein the blocking structure blocks the ink stabilizing material from entering the vent openings when the vent openings contact the blocking structure.

17. The method according to claim 15, further comprising wiping the nozzles and vent openings using a wiper of the printhead resting structure before repositioning the inkjet printhead in the cap.

18. The method according to claim 15, further comprising flushing the inkjet printhead to remove the ink stabilizing material from the nozzles and the vent openings.

19. The method according to claim 15, wherein the adjusting of the ink comprising applying a vacuum to an ink supply line of the inkjet printhead.

20. The method according to claim 15, wherein the ink stabilizing material is dispensed into the cap in a quantity to submerge the blocking structure.

* * * * *